United States Patent [19]

Haney

[11] Patent Number: 4,762,187

[45] Date of Patent: Aug. 9, 1988

[54] INTERNAL WRENCH FOR A TOP HEAD DRIVE ASSEMBLY

[75] Inventor: Keith M. Haney, Wichita Falls, Tex.

[73] Assignee: W-N Apache Corporation, Wichita Falls, Tex.

[21] Appl. No.: 79,024

[22] Filed: Jul. 29, 1987

[51] Int. Cl.[4] ..... E21B 19/16

[52] U.S. Cl. ..... 175/171; 175/113; 294/86.25; 294/95; 81/57.20; 81/57.34

[58] Field of Search ..... 175/170, 171, 189, 113; 294/86.24, 86.25, 95, 97; 81/57.15, 57.16, 57.20, 57.34, 57.35

[56] References Cited

U.S. PATENT DOCUMENTS

| | | | |
|---|---|---|---|
| 1,442,276 | 1/1923 | Jones et al. . | |
| 1,687,808 | 10/1928 | Thomas et al. . | |
| 1,843,537 | 2/1932 | Bickerstaff . | |
| 1,981,656 | 11/1934 | Masters et al. | 81/72 |
| 3,278,220 | 10/1966 | Wilson | 294/86.25 |
| 3,371,562 | 3/1968 | Kelley | 81/54 |
| 3,747,675 | 7/1973 | Brown | 166/237 |
| 3,776,320 | 12/1973 | Brown | 81/57.35 |
| 4,386,544 | 6/1983 | Fuminier | 82/101 |
| 4,589,503 | 5/1986 | Johnson et al. | 81/57.35 |
| 4,660,634 | 4/1987 | Johnson, Jr. | 81/57.34 |
| 4,667,752 | 5/1987 | Berry | 175/113 |

OTHER PUBLICATIONS

Weatherford Oilfield Power Equipment, pp. 12–13, describing Model CH 20 Chain Tongs.

*Primary Examiner*—Stephen J. Novosad
*Assistant Examiner*—Terry Lee Melius
*Attorney, Agent, or Firm*—Willian Brinks Olds Hofer Gilson & Lione Ltd.

[57] ABSTRACT

An internal wrench for an earth drilling machine of the type having a mast, a top head drive assembly mounted for movement along the mast and a quill rotated by the top head drive assembly includes a body having an upper end and a lower end sized to fit within a length of casing. The upper end of the body is mounted to the quill for rotation with the quill and several jaws are mounted to the lower end of the body to move between an extended position in which the jaws engage in interior surface of the casing to rotate the casing with the body, and a retracted position in which the jaws are out of engagement with the interior surface. The jaws are selectively moved between the extended and retracted positions in response to rotation of the body by a system which includes a drag ring which operates the jaws and a friction brake which engages the drag ring. A plug is mounted to an intermediate portion of the body to mate with threads at the upper end of the casing to seal off the casing. Followers on selected jaws automatically retract the jaws when the body is lowered into the casing to mate the plug with the threads at the upper end of the casing.

31 Claims, 8 Drawing Sheets

FIG. 5a
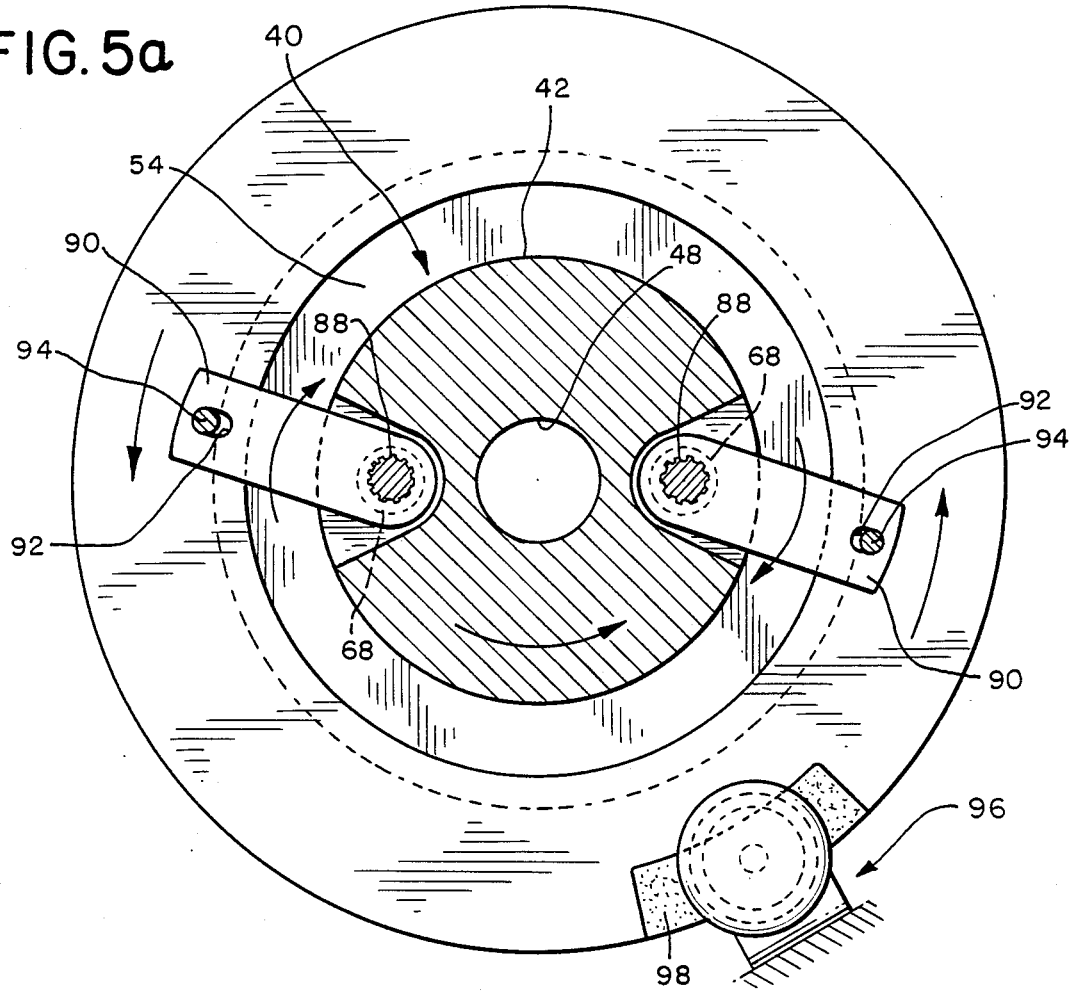
FIG. 4a
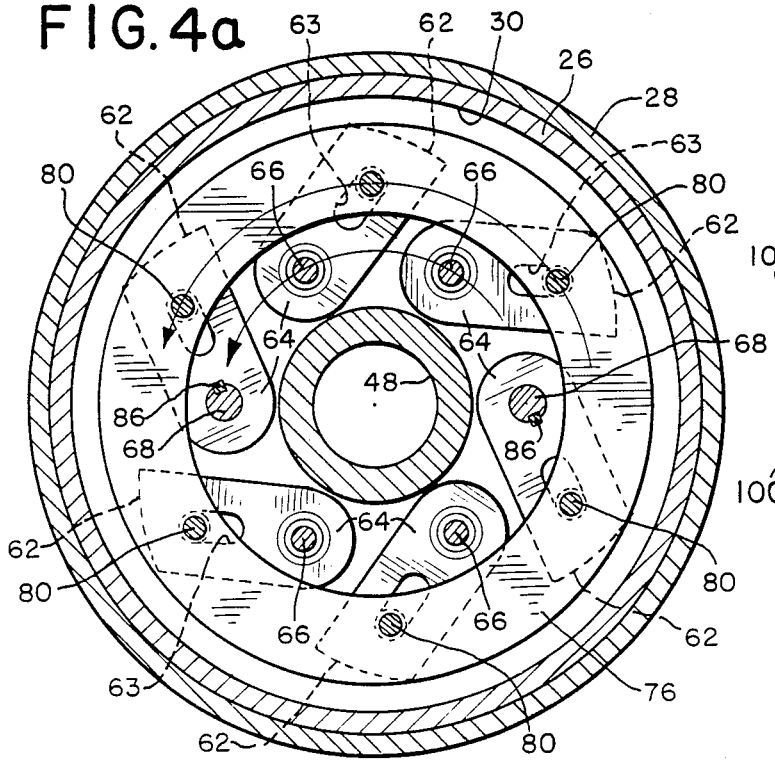
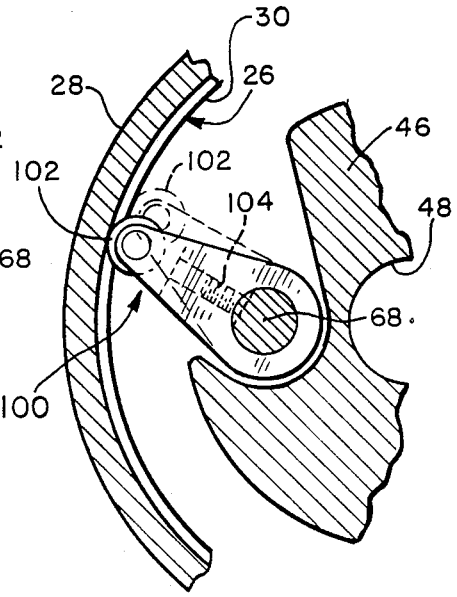
FIG. 6

INTERNAL WRENCH FOR A TOP HEAD DRIVE ASSEMBLY

CROSS REFERENCE TO RELATED APPLICATIONS

This application is a continuation-in-part of copending application Ser. No. 07/034,482 filed Apr. 2, 1987 now abandoned.

BACKGROUND OF THE INVENTION

The present invention relates to an apparatus for applying a torque to a drilling tubular in an earth drilling machine, and in particular to an apparatus for applying a torque to casing.

After a bore hole has been drilled in an earth formation, it is conventional in many applications to line the bore hole with a large diameter casing. Such casing is typically provided with threads at each end, and adjacent lengths of casing are threaded together to form a string of casing which is lowered into the bore hole. In assembling the string of casing it is necessary to apply a pre-determined torque to adjacent lengths of casing in order to make up the threaded joints properly.

In the past, hydraulic chain tongs such as Model CH-20 of Weatherford Company have been used to make up threaded joints on large diameter casing. Such chain tongs grip the exterior of the casing to apply the desired torque. Though suitable for many applications, such hydraulic chain tongs suffer from severe disadvantages that make them inappropriate for certain applications. Hydraulic chain tongs for large diameter casing are unacceptably large, heavy, slow, and expensive for the use with modern top head drive drilling machines of the type that provide limited space on the drilling floor around the string.

U.S. Pat. No. 3,747,675 to Brown discloses another rotary drive connection for casing drilling string. This drive connection is intended to interconnect a rotary swivel with a string of casing in a drilling operation, and it includes internal slips for lifting the string, elements for gripping the interior of the casing to rotate the string, and a sliding seal for sealing off the interior of the string. In that the seal engages the interior side wall of the casing, it does not utilize the threaded end of the casing to prevent drilling fluid from escaping from the casing. In many cases, the interior side wall is not sufficiently smooth or round to create an effective sealing surface. Furthermore, the internal gripping elements are designed to lock when the drive connection is rotated in a right hand sense, and no means are provided for selectively releasing the internal gripping elements while the drive connection is being rotated in a right hand sense. For these reasons, the sealing potential of the threaded upper end of the casing (which is machined to act as an excellent sealing surface) is not used and the associated advantages are lost.

The present invention is directed to an improved apparatus for applying torque to a drilling tubular such as a large diameter casing, which overcomes the disadvantages described above.

SUMMARY OF THE INVENTION

According to this invention an apparatus is provided for applying a torque to a tubular in an earth drilling machine of the type having a top head drive assembly. The apparatus of this invention includes a body having an upper end and a lower end. Means are provided for mounting the body beneath the top head drive assembly for rotation by the top head drive assembly. At least one jaw is secured to the lower end of the body for movement between at least one extended position in which the jaw engages an interior surface of the tubular to rotate the tubular with the body, and a retracted position in which the jaw is out of engagement with the interior surface. Means are provided for selectively moving the jaw between the extended and retracted positions.

In the preferred embodiments described below, a threaded plug is mounted to an intermediate portion of the body and is configured to mate with and seal off the upper end of the tubular. The body also defines a central passageway in these preferred embodiments which extends between the upper and lower portions to allow drilling mud to be introduced into the casing through the body. These embodiments use a jaw actuating system which includes a drag ring coupled to the jaw and a friction brake engaged with the drag ring such that the jaw can be set and released by rotation of the body in the appropriate direction. Means can be provided for overriding the jaw actuating system when it is desired to engage the threaded plug with the upper end of the tubular.

By engaging an interior surface of the tubular or casing, the apparatus of this invention provides a remarkably lightweight, compact, and inexpensive assembly which is well suited for use with top head drive drilling machines. Because the device is suspended from the top head drive assembly, a large working area on the drilling floor is not required. Furthermore, in the preferred embodiments described below the body can quickly be mated with the threaded upper end of the tubular or casing if there is a threat of a blowout, and drilling mud can then be injected into the tubular as needed to prevent the blowout. In this way, the upper end of the tubular is used to provide a reliable high pressure seal. Thus, the embodiments described below provide important safety advantages over the hydraulic chain tongs described above.

The invention itself, together with further objects and attendant advantages, will best be understood by reference to the following detailed description, taking in conjunction with the accompanying drawings.

BRIEF DESCRIPTION OF THE DRAWINGS

FIG. 4*a* is a cross-sectional view corresponding to FIG. 4 showing the jaws in the retracted position, out of contact with the length of casing.

FIG. 5*a* is a cross-sectional view corresponding to FIG. 5 showing the position of the torque arms with the jaws in the position of FIG. 4*a*.

FIG. 6 is a fragmentary cross section taken along line 6—6 of FIG. 3.

DETAILED DESCRIPTION OF THE PRESENTLY PREFERRED EMBODIMENTS

Figure 1:
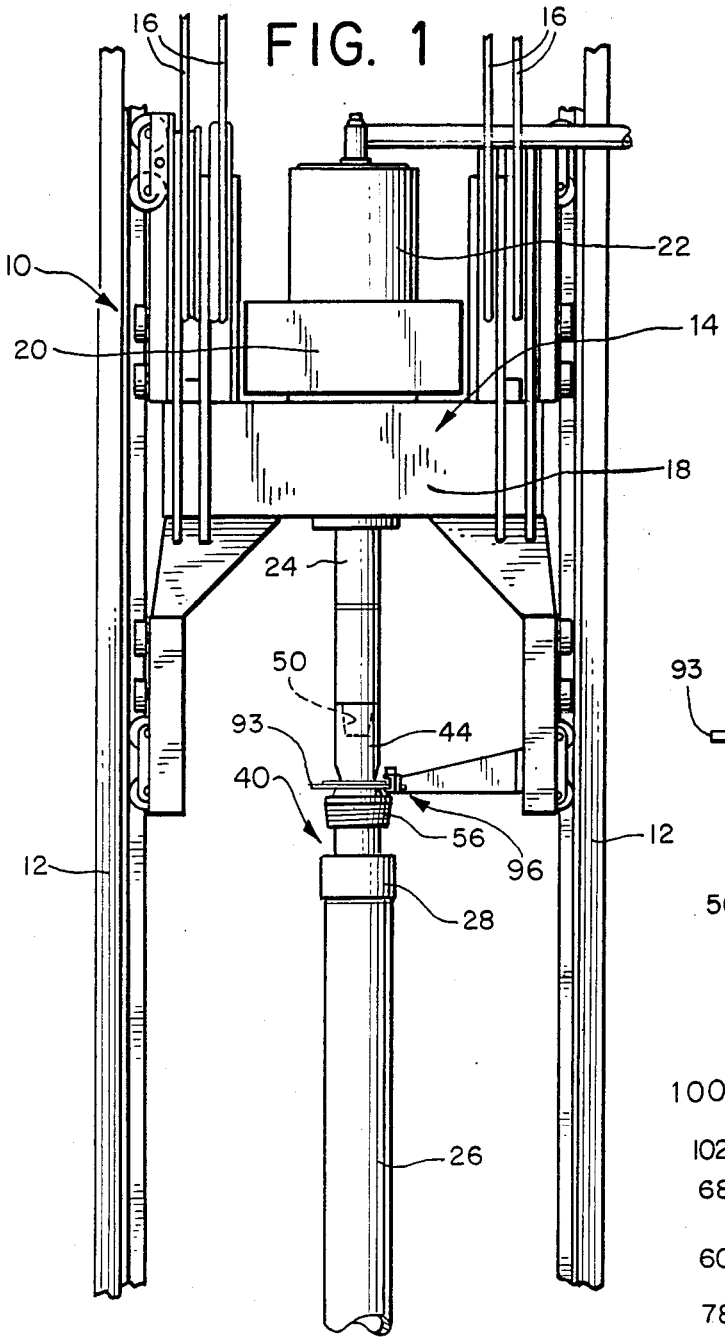
FIG. 1 is an elevation of a portion of a top head drive drilling machine on which is mounted a first presently preferred embodiment of this invention.

Turning now to the drawings, FIG. 1 shows an elevational view of a portion of a top head drive drilling machine 10 on which is mounted a first presently preferred embodiment of this invention. In the conventional manner, this drilling machine 10 includes a vertical mast 12 and a top head drive assembly 14 which is mounted for movement along the length of the mast 12. The top head drive assembly 14 is supported on the mast 12 by cables 16 which are controlled by conventional draw works (not shown) in order to position the top head drive assembly 14 at any desired point along the mast 12.

The top head drive assembly 14 includes a load beam 18 which forms the principal structural component of the top head drive assembly 14. A transmission 20 is mounted above the load beam, and one or more hydraulic or electric motors 22 supply power to the transmission 20 to rotate a quill 24. The quill 24 is used to suspend, lift and rotate down hole tubulars during drilling and casing operations. The foregoing features of the drilling machine 10 are conventional and have been described merely to clarify the environment of this invention. Further details will therefore not be provided here. Copending U.S. patent applications Ser. Nos. 07/035,021, 07/034,483, and 07/034,481 provide additional information concerning top head drive assemblies.

Figure 2:
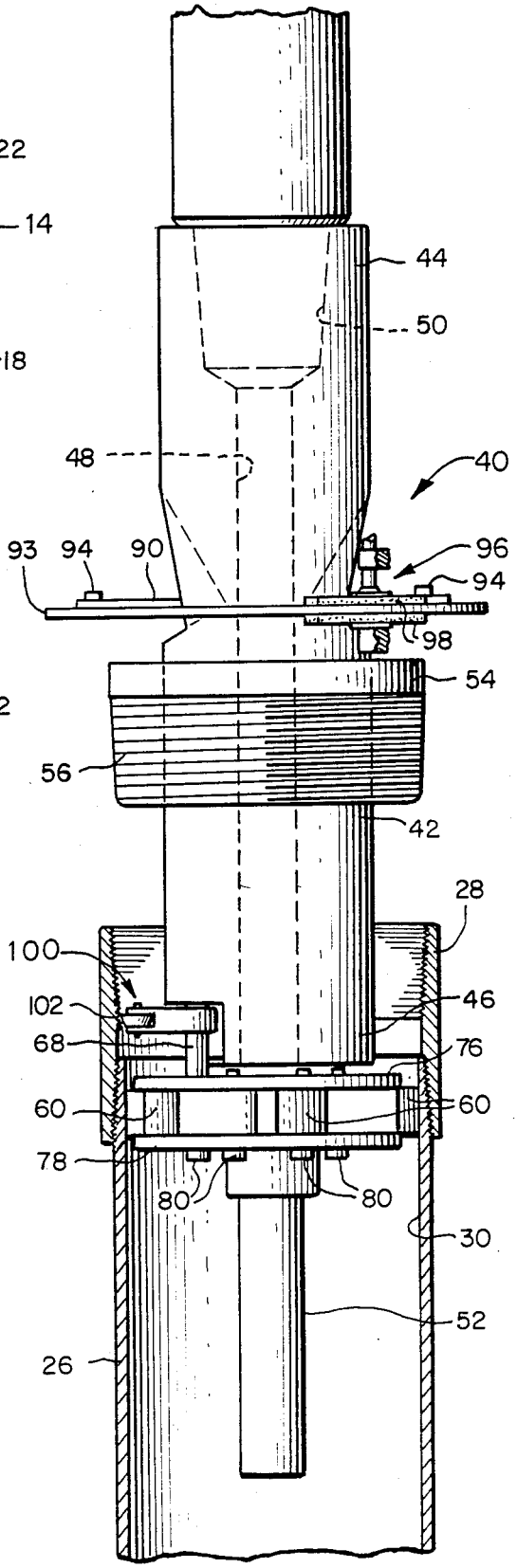
FIG. 2 is a more detailed elevation of the embodiment of FIG. 1.

As shown in FIG. 1 an internal wrench 40 is rigidly mounted to the lower end of the quill 24 so as to rotate in unison with the quill 24. This internal wrench 40 represents the presently preferred embodiment of the invention, and it is used to mechanically interconnect the quill 24 with a length of casing 26. As best shown in FIG. 2, this casing 26 is provided at its upper end with a coupling 28. As is conventional, both ends of the casing 26 are provided with external threads sized to mate with internal threads on the coupling 28. In use, adjacent lengths of casing 26 are secured together by means of the coupling 28. The casing 26 defines an internal surface 30 which as described below is engaged by the internal wrench 40.

FIG. 2 shows a more detailed elevation of the internal wrench 40. This wrench 40 includes a cylindrical body 42 which defines an upper end 44 and a lower end 46. As shown in FIG. 2 the body 42 and in particular the lower end 46 are shaped to fit within the casing 26. The body 42 defines a through passageway 48 which extends from the upper end 44 to the lower end 46. The upper end 44 of the body 42 defines a set of upper threads 50 which are adapted to mate with an adapter sub which is in turn threaded to the lower end of the quill 24. Thus, the upper threads 50 support the wrench 40 beneath the quill 24. A mud nozzle 52 is secured to the lower end 46 of the body 42 to direct drilling mud passing through the passageway 48 away from the lower end 46.

A plug 54 is securely and rigidly mounted to an intermediate portion of the body 42. This plug 54 defines a set of external threads 56 which are sized to mate with the uppermost threads of the coupling 28. When the plug 54 is screwed into the coupling 28 it seals off the upper end of the casing 26.

Turning now to FIGS. 3–6, the wrench 40 includes a set of jaws 60 which are pivotably mounted to the lower end 46 to move in a plane transverse to the passageway 48 between extended and retracted positions. Each of the jaws 60 defines an outer end 62 which is shaped to engage the internal surface 30 mechanically. Preferably, the outer ends 62 of the jaws 60 are hardened and shaped (as for example with teeth or by means of knurling) so as to bite into and securely grip the internal surface 30. In addition, each of the jaws 60 defines an inner end 64 as well as a respective slot 63 near the outer end 62. The inner ends 64 are pivotably mounted to the body 42 by means of pins 66 and shafts 68. In this embodiment a total of six jaws 60 and two shafts 68 are provided. Two diametrically opposed jaws 60 are mounted to the lower ends of the shafts 68 so as to rotate with the shafts 68. The remaining jaws 60 rotate about the pins 66 which are threadedly engaged with the lower end 46 of the body 42.

The shafts 68 are each mounted in a respective bore 58 defined by the body 42 to extend parallel to the passageway 48. As explained in detail below, these shafts 68 form part of a means for rotating the jaws 60 between the extended and retracted positions. Bushings 70 are provided around the shafts 68 and the pins 66 in order to reduce friction associated with movement of the jaws 60. Each of the shafts 68 is secured at its lower end to a respective one of the jaws 60 by means of a bolt 72 and a cap plate 74. A key 86 is provided between each of the shafts 68 and the respective jaw 60 to prevent the jaws 60 from rotating with respect to the shafts 68.

Figure 4:
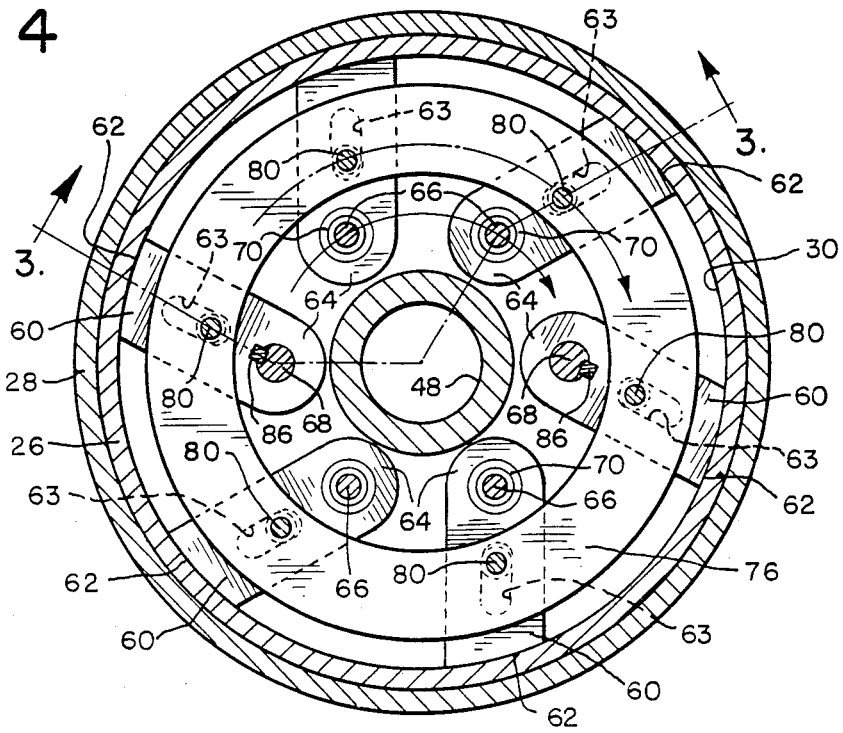
FIG. 4 is a cross-sectional view taken along line 4—4 of FIG. 3, showing the jaws in the extended position, engaged with a length of casing.

The jaws 60 are linked together by upper and lower rings 76, 78 to insure that the jaws 60 move in unison between the extended and retracted positions shown in FIGS. 4 and 4*a*, respectively. The upper and lower rings 76, 78 are secured together by pins 80 which ride in the slots 63. As explained in detail below, the shafts 68 rotate two of the jaws 60, and these jaws 60 in turn rotate the remaining jaws 60 by means of the rings 76, 78.

The bores 58 are sealed around the shafts 68 by O-ring seals 82. This is done to prevent high pressure fluids from escaping from the casing 26 via the bores 58 when the plug 54 is mated with the coupling 28. The shafts 68 are held in place in the bores 58 by locking rings 84.

Figure 3:
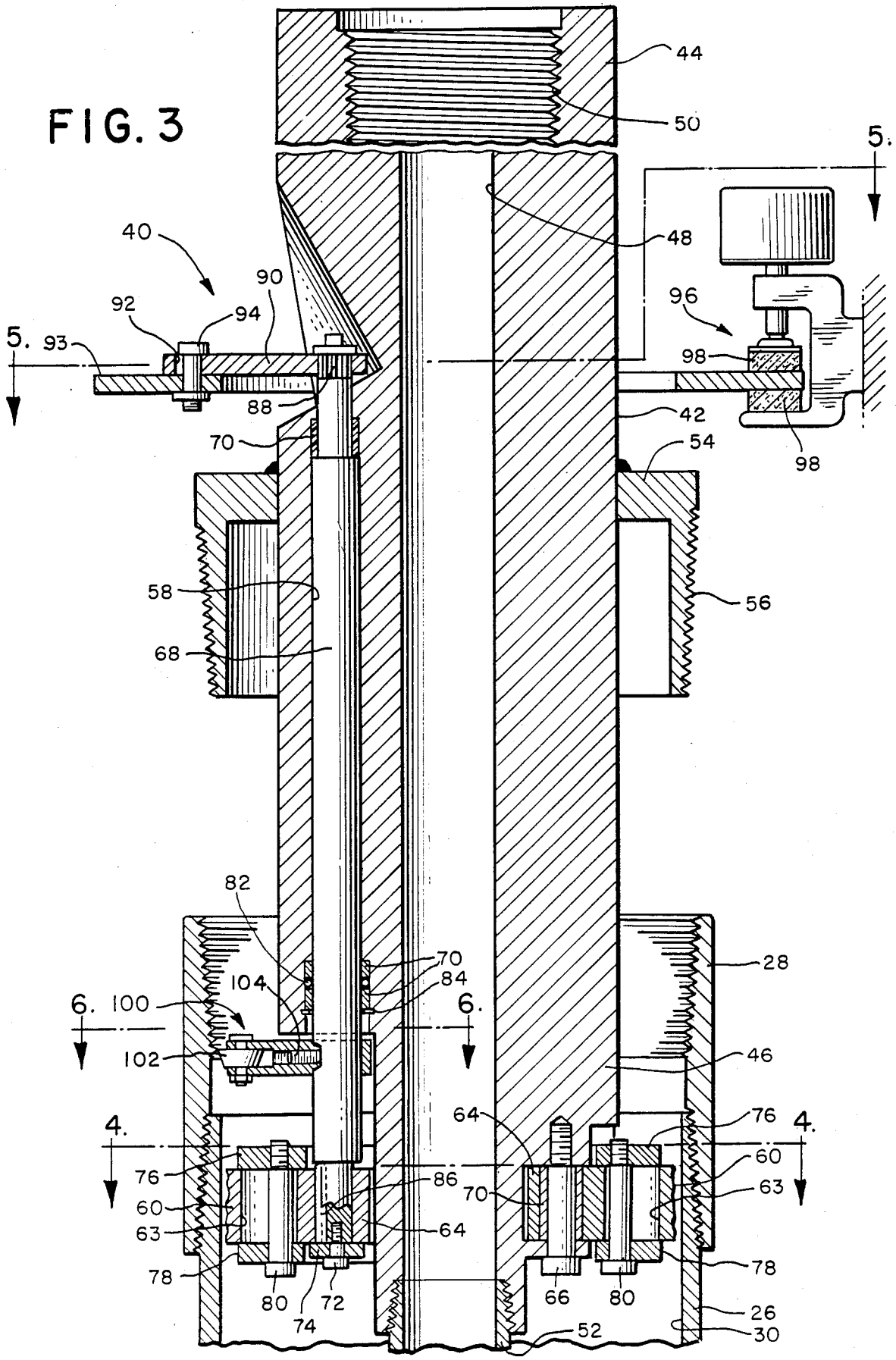
FIG. 3 is a longitudinal section taken along line 3—3 of FIG. 4.
Figure 5:
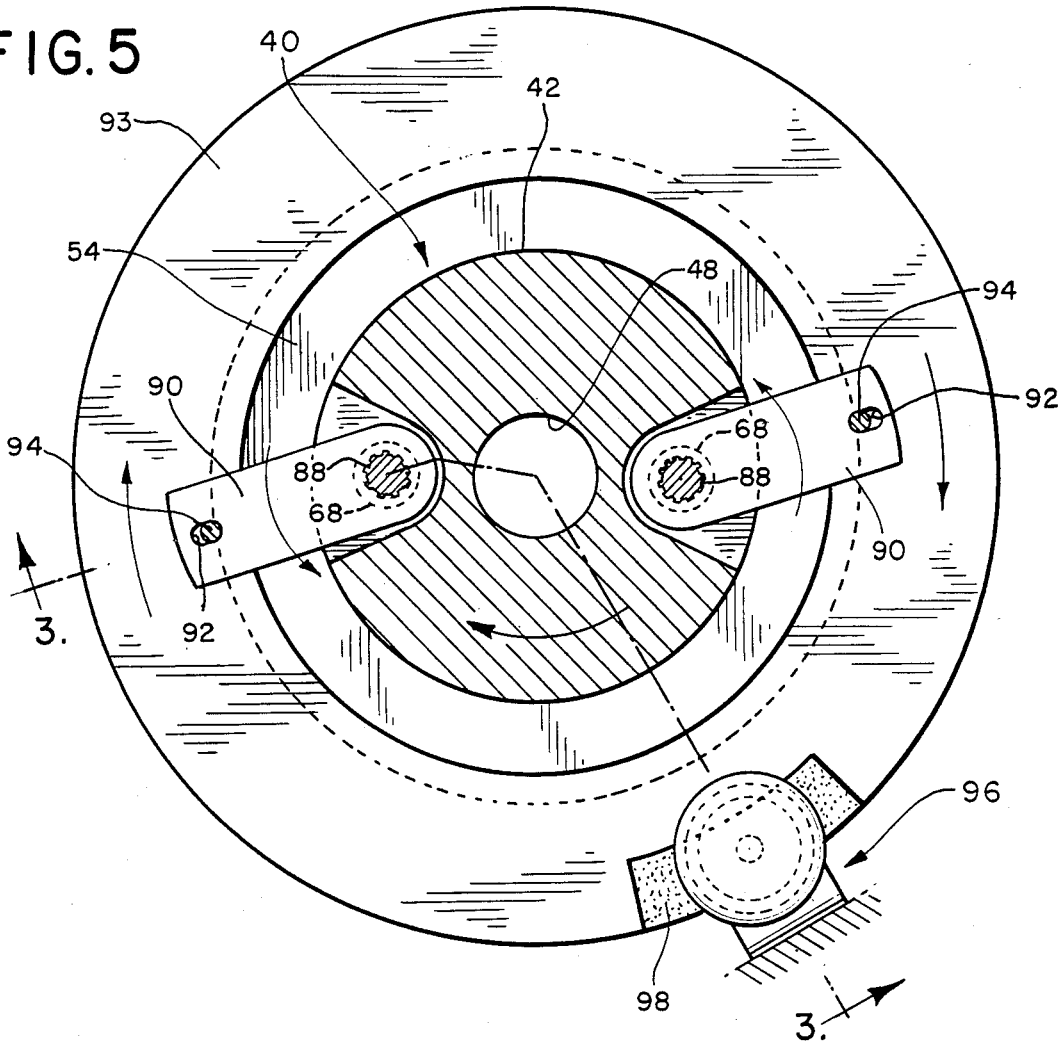
FIG. 5 is a cross-sectional view taken along line 5—5 of FIG. 3, showing the position of the torque arms with the jaws in the position of FIG. 4.

As best shown in FIG. 3, the upper ends of the shafts 68 are provided with splines 88 shaped to engaged correspondingly shaped openings in torque arms 90. These torque arms 90 extend laterally away from the body 40 along a plane transverse to the axis of the passageway 48, and each of the torque arms 90 defines a slot 92 at its outer end. A drag ring 93 is positioned to encircle the body 40, as best shown in FIG. 5. This drag ring 93 is supported in place by fasteners 94 positioned to slide in the slots 92. A friction brake 96 is mounted to the top head drive assembly 14. This friction brake 96 includes brake shoes 98 positioned to engage the drag ring 93 frictionally.

Turning now to FIGS. 3 and 6, a pair of followers 100 are mounted, each to a respective one of the shafts 68. Each of the followers 100 includes a roller 102 rotatably mounted on a shaft at the end of the follower 100. Each of the followers 100 is secured at a fixed rotational position with respect to the respective shaft 68 by means of a set screw 104 and a corresponding flat on the shaft 68.

The wrench 40 operates as follows. When it is desired to apply a torque to a casing 26 in order to make up the casing 26 with an adjacent coupling, the lower end 46 of the body 42 is lowered into the casing 26, to the approximate position shown in FIG. 2. Of course, at this time the jaws 60 are in the retracted position shown in FIG. 4*a*. The top head drive assembly 14 is then used to rotate the quill 24 so as to rotate the internal wrench 40 to make up the lower threaded connection of the casing 26. This rotation of the body 40 causes the friction brake 96 to shift the drag ring 93 with respect to the body 42 as shown in FIG. 5, thereby rotating the shafts 68 by the means of the torque arms 90. This rotation of the shafts 68 pivots the jaws 60 from the retracted position of FIG. 4*a* to the extended position of FIG. 4, thereby engaging the outer ends 62 of the jaws 60 with the internal surface 30 of the casing 26. The rings 76, 78 insure that all of the jaws 60 move in unison.

Once the jaws 60 have engaged the casing 26, further rotation of the wrench 40 cams or locks the jaws 60 into position, so that further slippage between the jaws 60 and the casing 26 does not occur. Then the desired torque is applied via the motors 22 and the transmission 20 to the quill 24. This torque is transmitted by the wrench 40 to the casing 26 in order to make up the lower threaded connection of the casing 26 to the desired torque. It has been found particularly advantageous to use shunt-wound DC electric motors for the motors 22. Such shunt-wound motors provide a torque which is substantially constant for a given amperage through the motor. Thus, by controlling motor amperage a pre-determined torque can be applied via the quill 24 and the internal wrench 40 to the casing 26. The shunt-wound electric motors supplied by the General Electric Company as Model No. 761 have been found particularly suitable.

After the casing 26 has been made up and it is desired to remove the internal wrench 40, the motor 22 is used to rotate the quill 24 in the reverse direction. This reverse rotation causes the friction brake 96 to shift the drag ring 93 with respect to the body 42 as shown in FIG. 5*a*, thereby rotating the shafts 68 in a reverse direction and pivoting the jaws from the extended position shown in FIG. 4 to the retracted position shown in FIG. 4*a*. In the retracted position the jaws 60 are out of contact with the internal surface 30 and the wrench 40 can easily be lifted out of the casing 26 without damaging the threads of the coupling 26.

In the event of a threat of a blowout during the time when the wrench 40 is engaged with the casing 26 as shown in FIG. 2, the wrench 40 can be used to prevent the blowout. The top head drive assembly 14 is merely lowered to cause the internal wrench 40 to move more deeply into the casing 26. The followers 100 normally ride in the coupling 28 above the upper end of the casing 26. In this position the followers 100 do not interfere with the proper setting of the jaws 60 as described above. However, when the wrench 40 is moved more deeply into the casing 26, the rollers 102 of the followers 100 engage the upper end of the casing 26 and then move into the casing 26. As this occurs, the followers 100 rotate the shafts 68 so as to move the jaws 60 to the retracted position, thereby overriding the forces applied to the jaws by the drag ring 93 tending to engage the jaws with the casing 26. Once the jaws 60 are out of engagement with the casing 26, continued rotation of the quill 24 as the wrench is lowered makes up the threads 56 of the plug 54 with the upper threads of the coupling 28. In this way, the upper end of the casing 26 can be sealed quickly. Once the casing 26 has been sealed, drilling mud can be introduced into the casing 26 by means of the central passageway 48 and the mud nozzle 52 in order to stabilize the mud in the bore hole.

A number of features of the wrench 40 cooperate to provide the advantages described above. The drag ring 93, torque arm 90 and shafts 68 cooperate to form means for pivoting the jaws 60 between the extended and retracted positions in response to rotation of the wrench 40. As explained above, rotation of the wrench 40 in the first direction sets the jaws 60 against the casing 26, and rotation in the reverse direction disengages the jaws 60 from the casing 26. This is a simple and effective method for controlling the jaws 60. The upper and lower rings operate as means for linking the jaws 60 together to insure that they move in unison. Of course, it should be understood that other means can be provided for pivoting the jaws 60, as for example hydraulic actuators or the like.

In addition, it should be noted that the followers 100 act as means for automatically withdrawing the jaws 60 from the casing 26 as the wrench 40 is moved beyond a pre-determined point into the casing 26. Again, other means can be provided for performing this function, as for example a means for selectively releasing the friction brake 96 so as to free the jaws 60 for movement away from the internal surface 30.

Furthermore, it is not essential in all embodiments to provide the passageway 48 and the plug 54. If the wrench 40 is adapted for uses where blowout prevention is not a concern, these elements can be eliminated.

Figure 7:
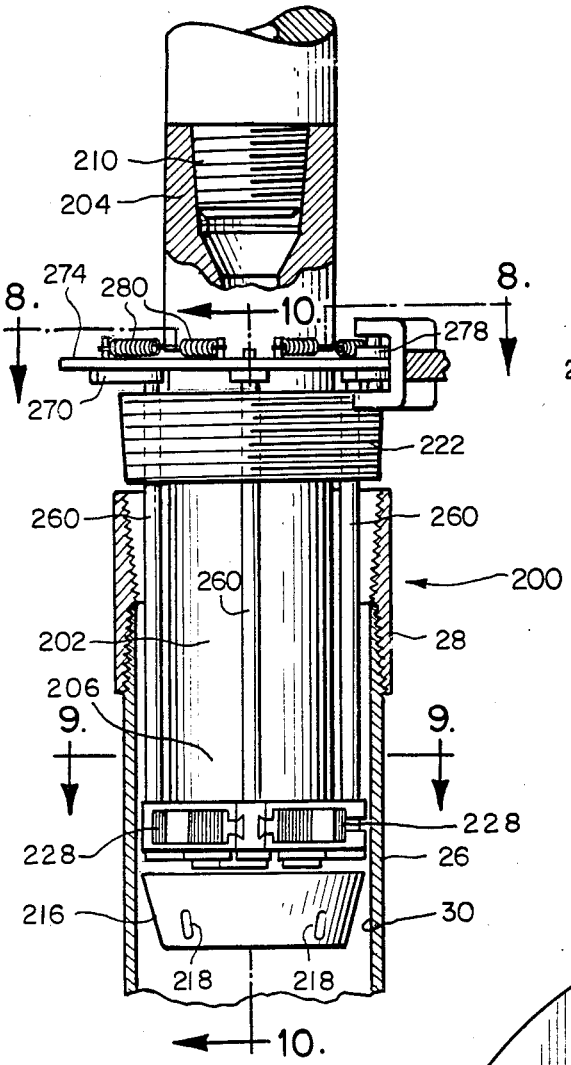
FIG. 7 is an elevational view in partial cutaway of a second preferred embodiment.
Figure 9:
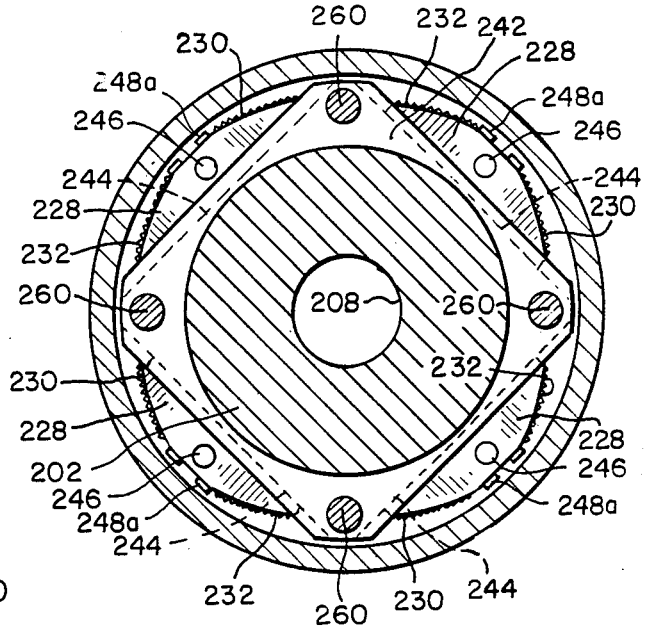
FIG. 9 is a cross section taken along line 9—9 of FIG. 7.
Figure 10:
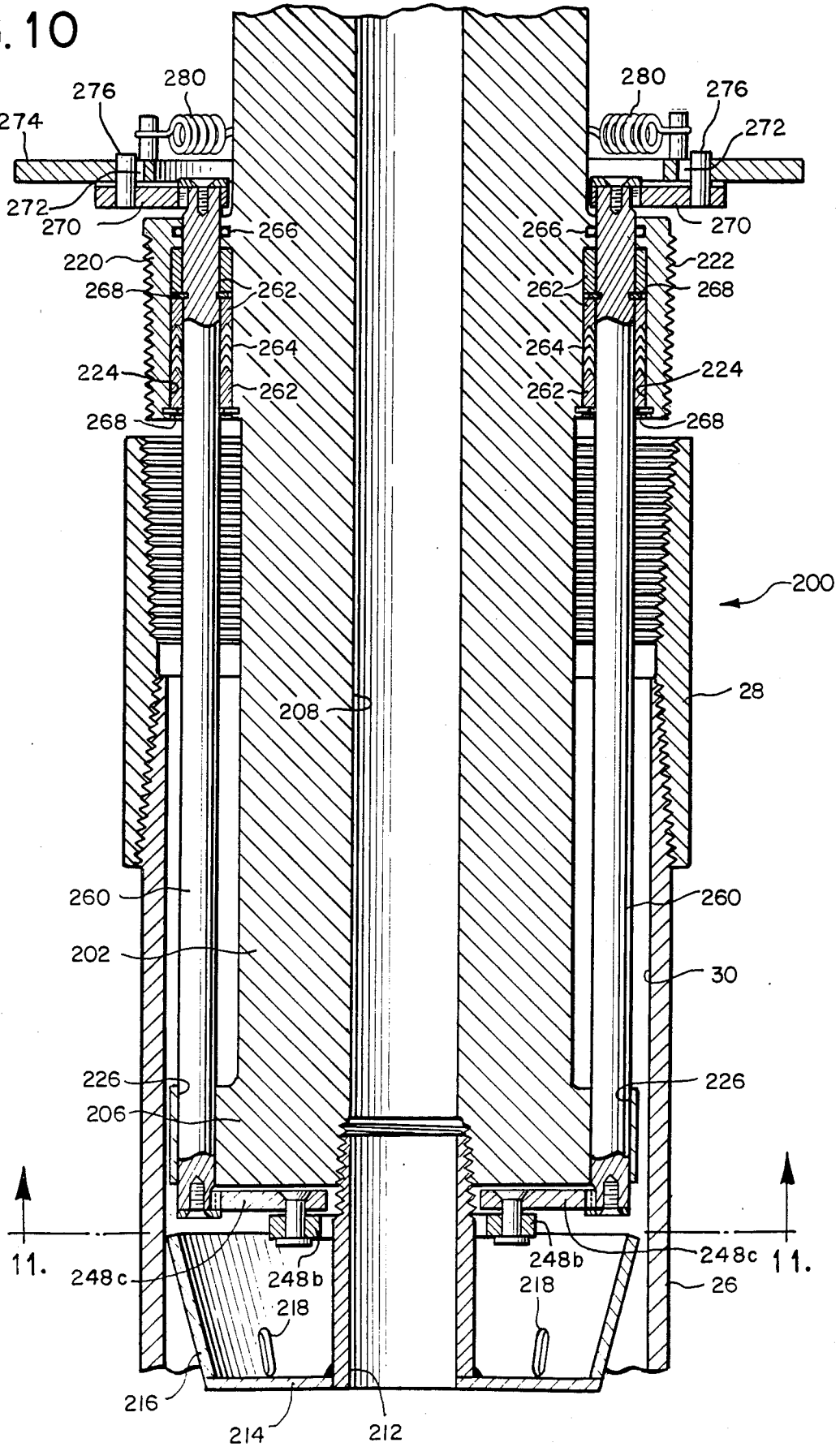
FIG. 10 is a longitudinal section taken along line 10—10 of FIG. 7.

Turning now to FIGS. 7–14, these figures show various views of a wrench 200 which incorporates a second preferred embodiment of this invention. This wrench 200 includes a body 202 which defines an upper end 204 and a lower end 206 (FIGS. 7 and 10). A central passageway 208 extends between the upper and lower ends 204, 206 to conduct drilling mud into a string of casing suspended by the wrench 200. The upper end 204 defines a set of upper threads 210 which are sized to mate with an adapter sub which is in turn threaded to the lower end of the quill 24 described above. Thus, the upper threads 210 support the wrench 200 beneath the quill 24. The lower end of the passageway 208 terminates in a mud nozzle 212, and the lowermost end of the mud nozzle 212 terminates in a basket made up of a flange 214 and a circumferential rim 216. The rim 216 defines an array of openings 218.

The body 202 defines a plug 220 at an intermediate position between the upper and lower ends 204, 206

(FIG. 10). This plug 220 defines a set of external threads 222 which are sized to mate with the internal threads of a cylindrical coupling 28 threadedly mounted to the upper end of a length of casing 26. The body 202 also defines an array of upper bores 224 and an aligned array of lower bores 226. As shown in FIGS. 7 and 9 the wrench 200 includes four jaws 228, each of which defines a first outer end 230 and a second outer end 232. As explained in detail below, the first outer ends 230 engage an interior surface 30 of the casing 26 for clockwise rotation of the casing 26 (as seen from above), and the second outer ends 232 engage the interior surface 30 in order to rotate the casing 26 in a counter-clockwise direction.

Figure 13:
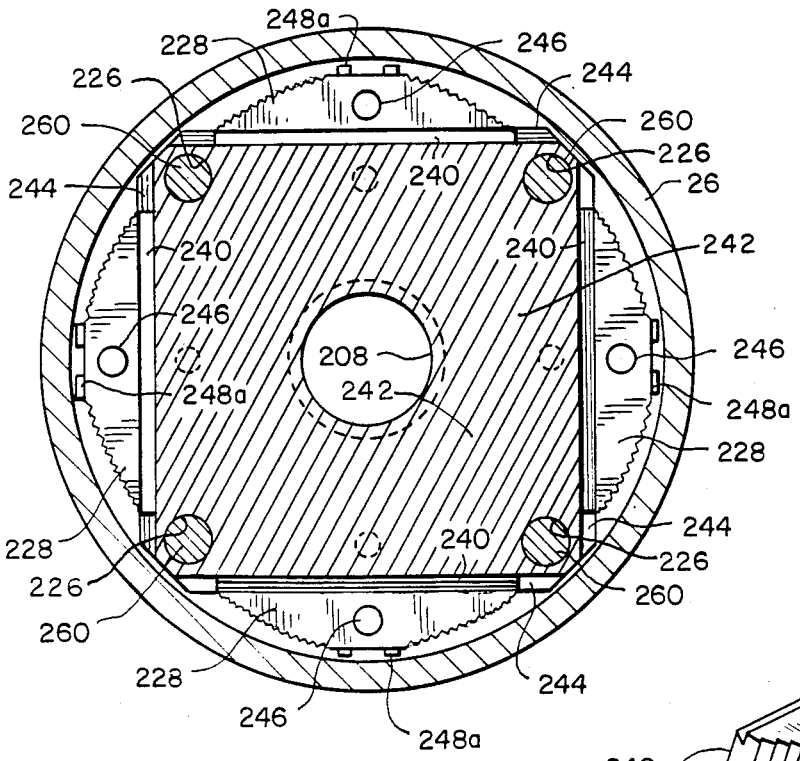
FIG. 13 is a cross section taken along line 13—13 of FIG. 12.
Figure 14:
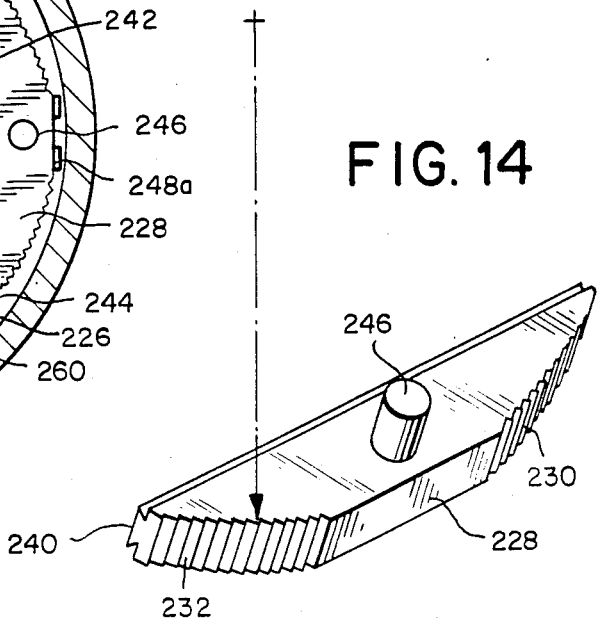
FIG. 14 is a perspective view of one of the jaws of the embodiment of FIGS. 7–13.

As best shown in FIG. 13 each of the jaws 228 defines a respective dovetail flange 240, and the jaws 228 are positioned adjacent to respective sides of a rectangular guide plate 242. The guide plate 242 defines four dovetail shaped guide slots 244, each of which receives a respective one of the dovetail flanges 240. Thus, each of the jaws 228 is guided for sliding movement parallel to one of the sides of the guide plate 242.

Figure 11:
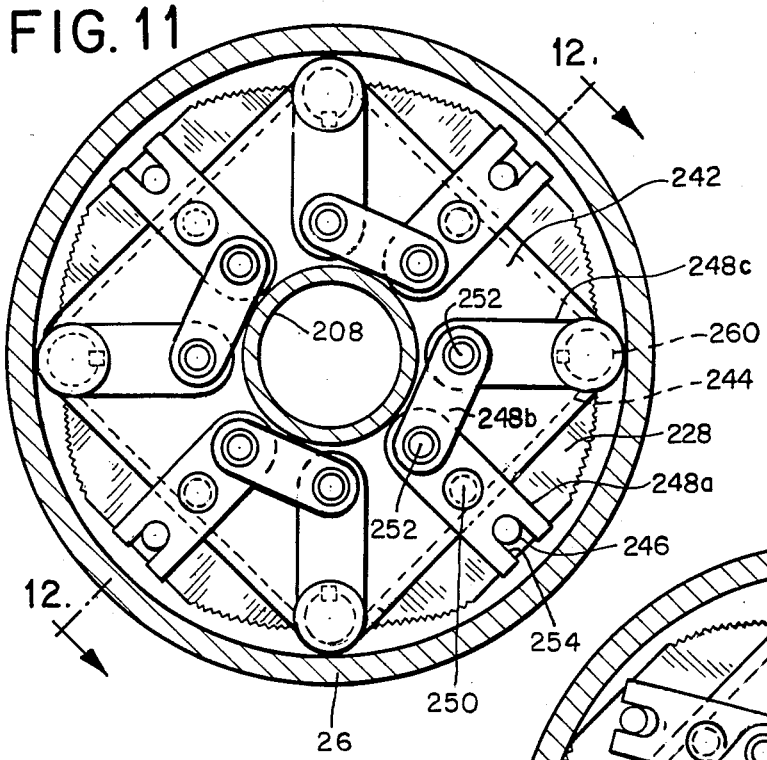
FIGS. 11, 11*a* and 11*b* are cross sections taken along line 11—11 of FIG. 10, showing the jaws centered (FIG. 11), positioned to make up a length of casing (FIG. 11*a*), and positioned to break out a length of casing (FIG. 11*b*).
Figure 11A:
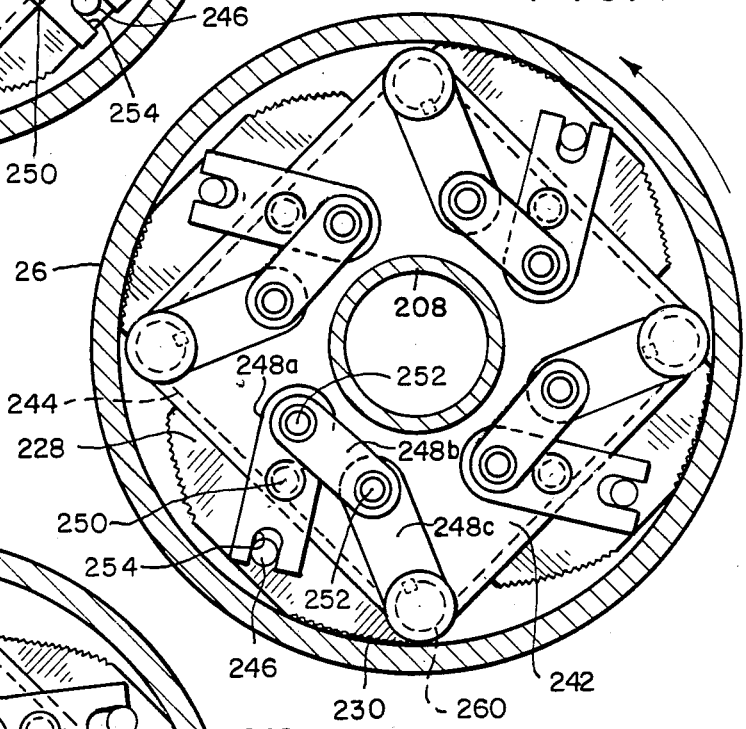
Figure 11B:
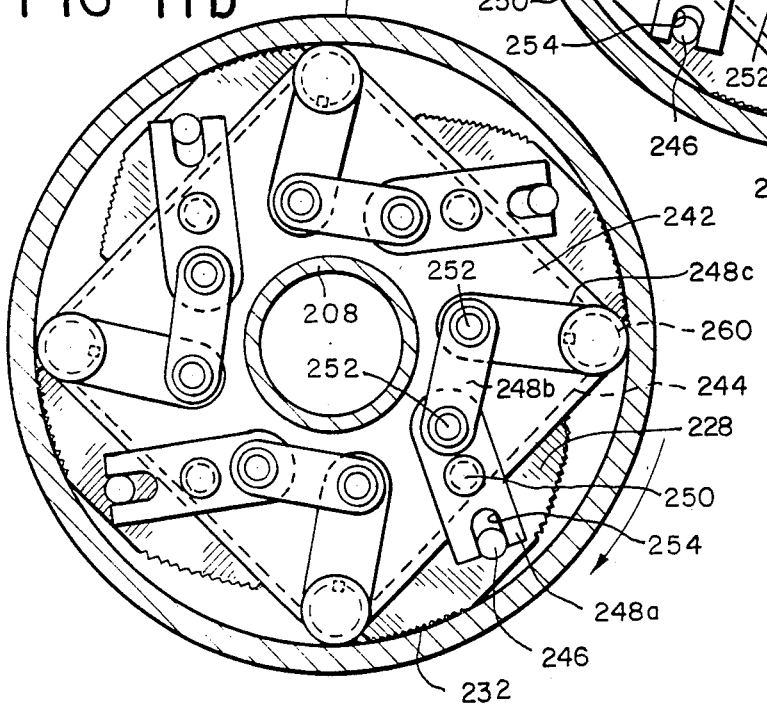
Figure 12:
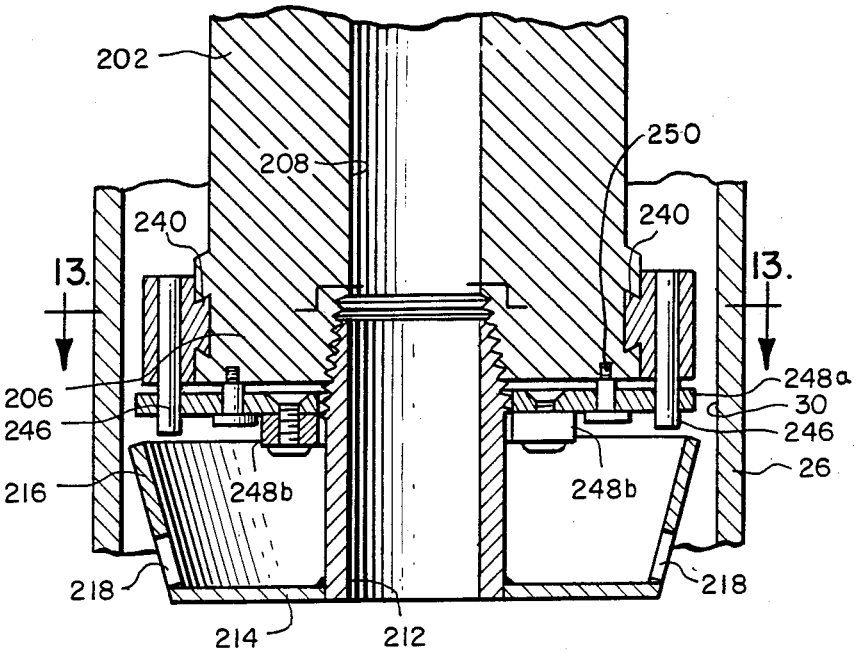
FIG. 12 is a partial longitudinal section taken along line 12—12 of FIG. 11.

Four shafts 260 are rotatably mounted in the bores 224, 226, and each of the shafts 260 is coupled to a respective one of the jaws 228 by a set of links 248*a*, 248*b*, 248*c* (FIG. 11). The links 248*a* are mounted to pivot about respective pins 250 which are secured to the guide plate 242. Each of the links 248*a* is coupled to a respective one of the jaws 228 by means of a slot 254 formed in the end of the link 248*a* and a pin 246 secured to the respective jaw 228. Each of the links 248*c* is keyed to a respective one of the shafts 260, and each of the links 248*b* interconnects the associated links 248*a*, 248*c* via pivots 252. Thus, rotation of the shafts 260 operates the linkage made up of the links 248*a*, 248*b*, 248*c* to move the jaws 228 between the extreme positions shown in FIGS. 11*a* and 11*b*. When the jaws 228 are in the position shown in FIG. 11*a*, the outer ends 232 are in contact with the interior surface 30 of the casing 26 such that the jaws 228 transmit torque effectively to the casing 26 to rotate the casing 26 in a clockwise direction (as seen from above). Similarly, when the jaws 228 are in the position shown in FIG. 11*b*, the outer ends 230 are in contact with the casing 26 to rotate the casing 26 in a counterclockwise direction (as seen from above). In each of these positions the jaws 228 are self-applying. Preferably, both of the ends 230, 232 are provided with directional gripping teeth as shown generally in FIG. 14.

Turning now to FIG. 10, the upper bores 224 are sealed around the shafts 260 by means of bronze bearings 262 and chevron seals 264 which are held in place by snap rings 268. In addition, an O-ring 266 is provided to reduce contamination of the bearings 262.

Figure 8:
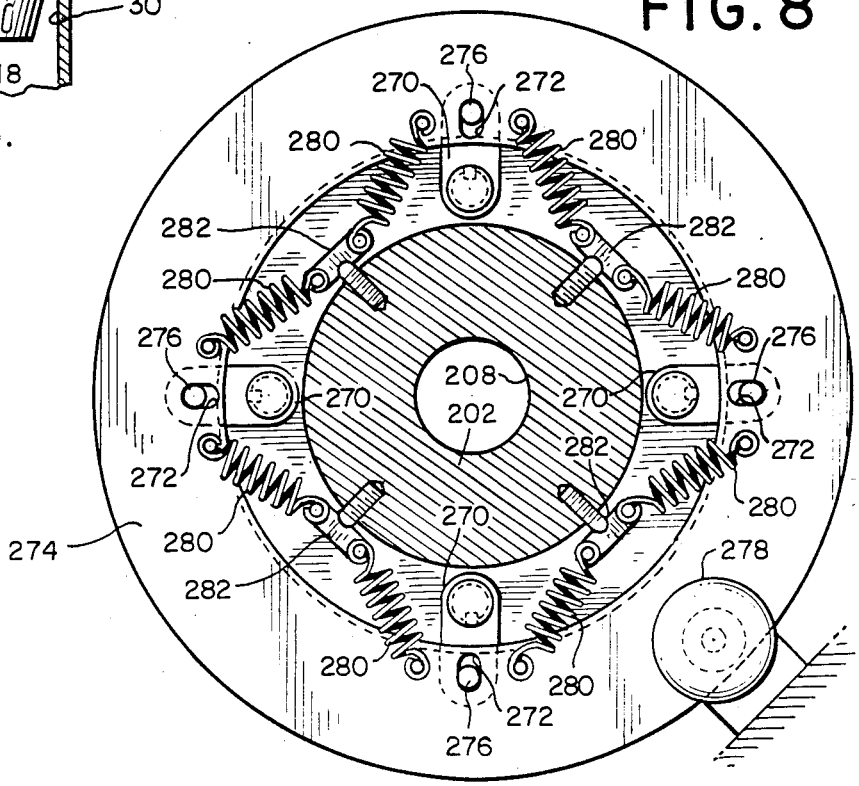
FIG. 8 is a cross section taken along line 8—8 of FIG. 7.

The upper end of each of the shafts 260 is keyed to a respective torque arm 270 which extends generally radially as shown in FIG. 8. Each of the torque arms 270 defines a respective slot 272 and the torque arms 270 support an annular drag ring 274. Fasteners 276 extend between the drag ring 274 and the torque arms 270 through the slots 272 in order to allow limited sliding motion between the torque arms 270 and the drag ring 274. A friction brake 278 such as a releasable air brake is schematically shown at 278. When applied, this brake 278 provides a frictional drag on the drag ring 274 in order to rotate the drag ring 274 with respect to the body 202. A set of springs 280 are mounted between the drag ring 274 and the body 202 by means of spring anchors 282, as shown in FIG. 8. These springs 280 are balanced so as to bias the drag ring 274 to the position shown in FIGS. 8 and 11, in which each of the torque arms 270 is positioned at the midpoint of its travel.

In use, the wrench 200 operates as follows. The body 202 is securely threaded in place to an adapter below the quill such that the body 202 is supported and rotated by the quill. When the wrench 200 is out of engagement with the casing 26 and the brake 278 is in the off position the springs 280 center the torque arms 270, thereby biasing the jaws 228 to a central, retracted position, in which neither of the ends 230, 232 is in contact with the casing 26 (FIG. 11). Then the lower end 206 of the body 202 is lowered into the casing 26 well past the coupling 28. The friction brake 278 is then set, and the quill is used to rotate the wrench 200 in a clockwise direction. Rotation of the wrench 200 in a clockwise direction shifts the drag ring 274 with respect to the body 202 and thereby moves the jaws 228 to the position shown in FIG. 11*a*, in which the jaws 228 grip the internal surface 30 of the casing 26 for clockwise rotation.

When it is desired to release the wrench 200 from the casing 26 the brake 278 is released and the wrench 200 is rotated by about 20 degrees in the counter-clockwise direction. This counter-clockwise rotation frees the jaws 228 from the casing 26 and allows the springs 280 to center the jaws 228, out of contact with the casing 26. Once the jaws 228 have been released, the wrench 200 can be withdrawn from the casing 26.

In the event the casing 26 must be rotated in a counter-clockwise direction (as for example when it is necessary to replace one or more casing joints in the event of damage to the casing joint resulting from overtorquing, damage to a coupling on the blowout preventer or the slips, or the like), the wrench 200 can be rotated in the counterclockwise direction while holding the brake 278 in engagement with the drag ring 274. When this is done the drag ring 274 is shifted with respect to the body 202 to move the jaws 228 to the position shown in FIG. 11*b*, in which the jaws 228 grip the casing 26 for counter-clockwise rotation. Thus, it can be seen that the wrench 200 is fully bidirectional and can be used both to make up and break out casing joints.

In the event of a kick or a threatened blowout the wrench 200 can be quickly disengaged from the casing 26 by releasing the brake 278 and rotating the wrench 200 slightly, as described above, and then the wrench 200 can be rotated in the clockwise direction as it is lowered. In that the brake 278 is disengaged from the drag ring 274, the jaws 228 remain in the retracted position shown in FIG. 11 and the threads 222 of the plug 220 can readily be engaged with the uppermost threads of the coupling 28 to form a fluid tight seal and thereby prevent a blowout. Drilling mud can be introduced as necessary through the passageway 208 into the casing string. As pointed out above, the coupling 28 is designed to create a fluid tight threaded seal, and thus the plug 220 provides a reliable and effective seal for the casing 26. The seals including the chevron seal 264 and the O-ring 266 prevent the leakage of drilling fluid through the plug 220.

The wrench 200 provides a number of important advantages. Perhaps most importantly the jaws 228 are fully bidirectional, up to the breakout torque of the threaded connections between the wrench 200 and the quill 24. As explained above the wrench 200 can be used both to make up and break out threaded connections with the casing 26. Additionally, the jaws 228 contact the casing 26 well into the casing 26 and some distance from the coupling 28. In this way the risk of damaging the threads near the upper end of the casing 26 due to out of roundness or "egging" during torquing operations is minimized. In addition, the shafts 260 are positioned radially outside the structural portion of the body 202, thereby eliminating stress risers. The wrench 200 can safely rotate, support, and isolate the entire casing string during any kick requiring that the wrench be made up to the casing coupling to prevent a blowout. Finally, the basket made up of the flange 214 and the rim 216 is configured to provide a stable base or support for the wrench 200 to allow the wrench 200 to be stored and transported in a vertical position. This basket also performs as a mud shield and as an extended mud injection pipe to reduce the amount of drilling mud that splashes onto the jaws 228 and the associated linkage. Finally, the basket substantially blocks the interior of the casing 22 to prevent small pieces or parts from falling into the bore hole in the event of a catastrophic failure of the internal mechanism of the wrench 200.

From the foregoing description it should be apparent that the wrenches described above are relatively lightweight and compact, and are well-suited for use with top head drive drilling machines. They can make up quickly with a casing if necessary to control or prevent a blowout, and they allow drilling mud to be injected into the casing promptly in response to a problem. All of these advantages are obtained in a reliable device which is relatively straightforward to manufacture.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

I claim:

1. An apparatus for applying a torque to a tubular in an earth drilling machine of the type having a top head drive assembly, wherein the tubular defines an upper threaded end, said apparatus comprising:

a body having an upper portion and a lower portion, said body defining a passageway which extends between the upper and lower portions;

means for supporting the upper portion of the body under the top head drive assembly;

a plug mounted to an intermediate portion of the body, said plug defining a set of threads configured to threadedly engage the upper threaded end of the tubular to create a fluid tight seal with the tubular;

means for releasably engaging the lower portion of the body with an interior surface of the tubular positioned below the threaded end, said engaging means movable between a disengaged position in which the body is free to rotate independently of the tubular, and at least one engaged position, in which the body and the tubular are mechanically engaged with one another to rotate together; and means for moving the engaging means away from the at least one engaged position to free the body for rotation with respect to the tubular to engage the plug threads with the upper threaded end of the tubular to seal off the tubular.

2. The invention of claim 1 wherein the lower portion of the body is sized to fit within the tubular.

3. The invention of claim 1 wherein the supporting means comprises:

a set of threads formed on the upper portion of the body around the passageway.

4. The invention of claim 1 wherein the releasably engaging means comprises:

a plurality of jaws;

means for pivotably mounting the jaws to the lower portion of the body such that the jaws are pivotable between an extended position, in which the jaws engage the interior surface of the tubular, and a retracted position, in which the jaws are out of contact with the interior surface of the tubular; and means for pivoting the jaws with respect to the body between the extended and retracted positions.

5. The invention of claim 4 wherein the pivoting means comprises:

means for pivoting the jaws to the extended position when the body is rotated in a first direction and for pivoting the jaws to the retracted position when when the body is rotated in a second direction, opposed to the first direction.

6. The invention of claim 4 wherein the pivoting means comprises:

a drag ring;

a friction brake engaged with the drag ring; and means for coupling the drag ring to the jaws such that rotation of the body in a first direction causes the friction brake to move the drag ring to pivot the jaws to the extended position, and rotation of the body in a second direction causes the friction brake to move the drag ring to pivot the jaws to the retracted position.

7. The invention of claim 6 wherein the means for moving the engaging means away from the engaged position comprises:

at least one follower; and means for coupling the follower to at least one of the jaws such that the follower normally extends above the tubular when the jaws are in the extended position and the follower automatically moves the jaws to the retracted position as the follower moves into the tubular.

8. The invention of claim 1 wherein the releasably engaging means comprises:

a plurality of jaws;

means for movably mounting the jaws to the lower portion of the body such that the jaws are movable between a first extended position, in which the jaws engage the interior surface of the tubular to rotate the tubular in a clockwise direction, a second extended position, in which the jaws engage the interior surface of the tubular to rotate the tubular in a counter-clockwise direction, and a retracted position, in which the jaws are out of contact with the interior surface of the tubular; and means for moving the jaws between the retracted position and the first and second extended positions.

9. The invention of claim 8 wherein the jaw moving means comprises:

means for moving the jaws to the first extended position when the body is rotated in the clockwise direction and for moving the jaws to the second extended position when the body is rotated in the counter-clockwise direction.

10. The invention of claim 8 wherein the jaw moving means comprises:

a drag ring;

a friction brake engaged with the drag ring; and means for coupling the drag ring to the jaws such that rotation of the body in the clockwise direction causes the friction brake to move the drag ring to move the jaws to the first extended position, and rotation of the body in the counter-clockwise direction causes the brake to move the drag ring to pivot the jaws to the second extended position.

11. The invention of claim 10 wherein the jaw mounting means comprises a jaw guide mounted to the body and engaged with the jaws by a sliding dovetail joint.

12. The invention of claim 10 wherein the jaw moving means further comprises spring means for biasing the jaws to the retracted position.

13. In combination with an earth drilling machine of the type comprising: a mast, a top head drive assembly mounted for movement along the mast, a quill included in the top head drive assembly, and means included in the top head drive assembly for rotating the quill; an apparatus for applying torque to a casing, said apparatus comprising:

a body having an upper end and a lower end;

means for mounting the upper end of the body to the quill for rotation with the quill;

at least one jaw;

means for mounting the jaw to the lower end of the body for movement between at least one extended position, in which the jaw engages an interior surface of the casing to rotate the casing with the body, and a retracted position, in which the jaw is out of engagement with the interior surface;

means for selectively moving the jaws between the extended and retracted positions, said moving means comprising:

a drag ring disposed around an intermediate portion of the body;

a friction brake mounted to the top head drive assembly to engage the drag ring; and means for coupling the drag ring to the jaws such that relative movement between the drag ring and the body in a first direction moves the jaws to a first one of the at least one extended positions and relative movement between the drag ring and the body in a second direction moves the jaws away from the first one of the extended positions.

14. The invention of claim 13 wherein the lower end of the body is sized to fit within the casing.

15. The invention of claim 14 wherein the body defines a passageway extending between the upper and lower ends of the body, and wherein the invention further comprises:

a plug mounted to an intermediate portion of the body and threaded to mate with the casing.

16. The invention of claim 13 wherein the body mounting means comprises:

a set of threads formed on the upper end of the body.

17. The invention of claim 15 wherein the moving means further comprises:

means for automatically moving the jaws to the retracted position as the body is inserted into the casing beyond a selected point.

18. The invention of claim 17 wherein the means for automatically moving the jaws to the retracted position comprises:

a follower; and means for coupling the follower to the jaws such that the follower moves the jaws to the retracted position when the follower engages the casing.

19. The invention of claim 13 wherein the at least one extended position comprises a first extended position in which the jaws are positioned to rotate the tubular in a clockwise direction and a second extended position in which the jaws are positioned to rotate the tubular in a counter-clockwise position, and wherein the retracted position is interposed between the first and second extended positions.

20. The invention of claim 19 the means for selectively moving the jaws further comprises spring means for resiliently biasing the jaws to the retracted position.

21. The invention of claim 19 wherein the means for coupling the drag ring to the jaws moves the jaws to the first extended position when the body is rotated in the clockwise direction and moves the jaws to the second extended position when the body is rotated in the counter-clockwise direction.

22. In combination with an earth drilling machine of the type comprising: a mast, a top head drive assembly mounted for movement along the mast, a quill included in the top head drive assembly, and means included in the top head drive assembly for rotating the quill; an apparatus for applying torque to a casing, said apparatus comprising:

a body which defines an upper end, a lower end, a passageway extending between the ends, a set of threads in the upper end adapted to support the body below the quill for rotation with the quill, and at least one bore parallel to the passageway, said lower end sized to fit within the casing;

a plurality of jaws pivotably mounted to the lower end of the body, each of said jaws defining an outer end adapted to engage an interior surface of the casing;

means for linking the jaws together to pivot in unison between an extended position, in which the outer ends of the jaws contact an interior surface of the casing to lock the casing and the body together, and a retracted position, in which the outer ends of the jaws are disposed out of contact with the casing between the casing and the body;

at least one jaw pivoting shaft disposed in the bore and engaged at a lower end of the shaft with one of the jaws such that rotation of the shaft in the bore pivots the associated jaws between the extended and retracted positions;

means for sealing the bore around the shaft;

a torque arm secured to the shaft above the sealing means and extending laterally away from the body;

means for selectively moving the torque arm to control the rotational position of the shaft in the bore and therefore the position of the jaws; and a plug mounted to the body between the torque arm and the jaws, said plug defining a set of threads sized to mate with and seal off the casing.

23. The invention of claim 22 wherein the moving means comprises:

a drag ring mounted to the torque arm to encircle the body; and a friction brake mounted to the top head drive assembly to engage the drag ring such that rotation of the body in a first direction rotates the shaft in the bore to move the jaws to the extended position, and rotation of the body in a second direction rotates the shaft in the bore to move the jaws to the retracted position.

24. The invention of claim 22 further comprising:

means for moving the jaws to the retracted position when the body is inserted into the casing sufficiently to engage the plug with the casing.

25. The invention of claim 24 wherein the means for moving the jaws to the retracted position comprises:

a follower; and means for coupling the follower to the jaws such that the follower moves the jaws to the retracted position when the follower engages the casing.

26. The invention of claim 25 wherein the means for coupling the follower to the jaws comprises:

means for coupling the follower to the shaft such that the follower extends parallel to the jaws.

27. In combination with an earth drilling machine of the type comprising: a mast, a top head drive assembly mounted for movement along the mast, a quill included in the top head drive assembly, and means included in the top head drive assembly for rotating the quill; an apparatus for applying torque to a casing, said apparatus comprising:

a body which defines an upper end, a lower end, a passageway extending between the ends, a set of threads in the upper end adapted to support the body below the quill for rotation with the quill, and at least one bore parallel to the passageway, said lower end sized to fit within the casing;

a plurality of jaws slideably mounted to the lower end of the body, each of said jaws defining first and second outer ends adapted to engage an interior surface of the casing;

at least one jaw positioning shaft disposed in the bore for rotation;

means for linking the at least one jaw positioning shaft with the jaws such that rotation of the shaft in a first direction moves the jaws to a first extended position in which the first outer ends engage the interior surface of the casing for rotation in a clockwise direction and rotation of the shaft in a second direction moves the jaws to a second extended position in which the second outer ends engage the interior surface of the casing for rotation in a counter-clockwise direction;

means for sealing the bore around the shaft;

a torque arm secured to the shaft above the sealing means and extending away from the body;

means for selectively moving the torque arm to control the rotational position of the shaft in the bore and therefore the position of the jaws; and a plug mounted to the body between the torque arm and the jaws, said plug defining a set of threads sized to mate with and seal off the casing;

said jaws dimensioned to remain out of contact with the casing when positioned in a retracted position, intermediate the first and second extended positions.

28. The invention of claim 27 wherein the moving means comprises:

a drag ring mounted to the torque arm to encircle the body; and a friction brake mounted to the top head drive assembly to engage the drag ring such that rotation of the body in the clockwise direction rotates the shaft in the bore to move the jaws to the first extended position, and rotation of the body in the counter-clockwise direction rotates the shaft in the bore to move the jaws to the second extended position.

29. The invention of claim 27 wherein the moving means comprises spring means for resiliently biasing the jaws to the retracted position.

30. The invention of claim 27 further comprising a mud nozzle mounted to the body in alignment with the passageway, said mud nozzle defining an enlarged lower end that simultaneously protects the jaws from impact and contamination, forms a stable support for the body, and acts as a basket to prevent objects from falling into the casing.

31. The invention of claim 1 wherein the plug is non-rotatably mounted on the intermediate portion of the body.

* * * * *